United States Patent [19]

Sweet, III

[11] 4,195,739

[45] Apr. 1, 1980

[54] SPOOL HOLDER

[76] Inventor: John R. Sweet, III, 21800 Wright Ct., Sunnyvale, Calif. 94087

[21] Appl. No.: 905,986

[22] Filed: May 15, 1978

[51] Int. Cl.[2] ..... A47F 7/00

[52] U.S. Cl. ..... 211/113; 206/391; 211/60 S

[58] Field of Search ..... 211/113, 13, 60 T, 60 R, 211/34, 35, 38, 86, 72, 59.1, 118, 60 S; 206/391, 278, 443, 286, 280, 484; 242/130, 132, 134, 137; 190/51

[56] References Cited

U.S. PATENT DOCUMENTS

| | | | |
|---|---|---|---|
| 2,359,372 | 10/1944 | Leader | 211/35 X |
| 2,929,509 | 3/1960 | Van Dusen | 211/59.1 |
| 3,286,831 | 11/1966 | Giberstein | 206/278 |
| 3,297,290 | 1/1967 | Patterson | 211/59.1 X |
| 3,512,634 | 5/1970 | Burch | 206/391 |
| 3,686,820 | 8/1972 | Zenger et al. | 206/445 X |
| 3,827,571 | 8/1974 | Koutny | 211/59.1 |
| 3,841,475 | 10/1974 | Ellis | 206/391 |
| 3,923,577 | 12/1975 | Baab | 206/278 X |

*Primary Examiner*—Roy D. Frazier
*Assistant Examiner*—Robert W. Gibson, Jr.

[57] ABSTRACT

A spool holder for holding and displaying a plurality of spools of sewing thread.

6 Claims, 6 Drawing Figures

SPOOL HOLDER

BACKGROUND OF THE INVENTION

This invention relates generally to a thread spool holder and more particularly to a spool holder for holding a plurality of spools to display the stored thread.

At present, spool holders or storage means include drawers where the spools are stored. Some drawers are provided with dividers and spool holders whereby the spools are neatly stored and displayed. In most instances, however, the spools are loosely held and there is a tendency for the threads stored thereon to unwind and tangle with one another as the spools move during opening and closing of the drawers. Drawers usually occupy a large amount of space and yet store a small number of spools.

Another type of spool holder includes a plurality of pegs on which the spools are placed. Such holders may be placed in drawers or mounted on the wall adjacent the work space. If the spool holders are stored in the open, they collect dust, which discolors the exposed outer layer of thread.

In general, the prior art spool holders require a large space, are relatively expensive to manufacture and do not efficiently and effectively display the spools whereby particular threads and colors can be easily identified.

OBJECTS AND SUMMARY OF THE INVENTION

It is a general object of the present invention to provide a spool holder which displays stored spools.

It is another object of the present invention to provide a spool holder which occupies minimum space.

It is still a further object of the present invention to provide a spool holder which individually houses spools.

It is a further object of the present invention to provide a spool holder which inhibits unwinding and tangling of stored threads by holding the spools in pockets.

It is another object of the present invention to provide a spool holder which is simple in construction and inexpensive to manufacture.

It is still a further object of the present invention to provide a spool holder which can be made to hold spools of various sizes.

The foregoing and other objects of the invention are achieved by a spool holder which includes a pair of elongated strips of transparent elastic material disposed face to face and connected to one another at spaced intervals to define a plurality of spool pockets for receiving and holding spools.

DESCRIPTION OF PREFERRED EMBODIMENTS

Figure 1:
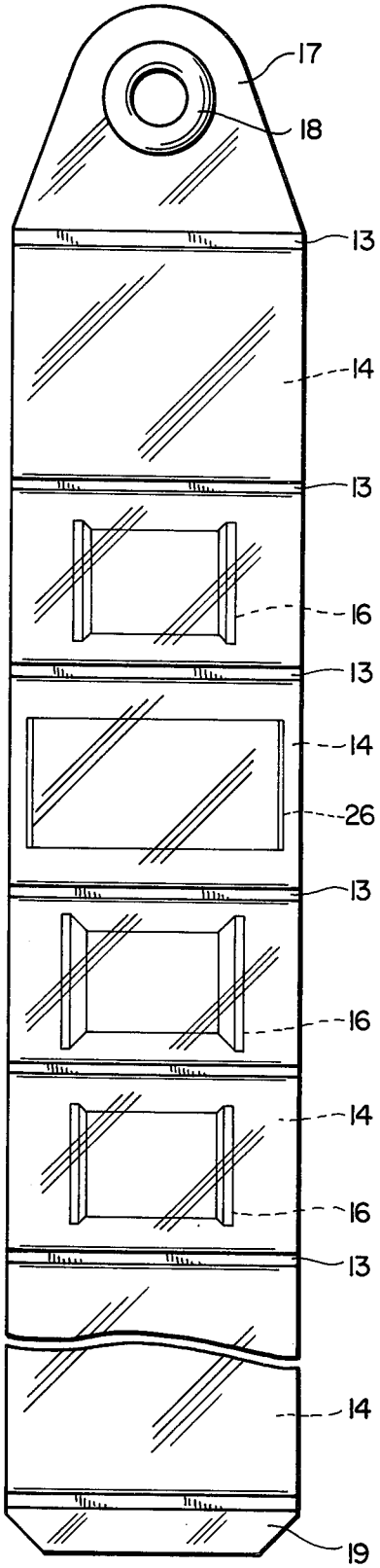
FIG. 1 is a front elevational view of a spool holder in accordance with the present invention.
Figure 2:
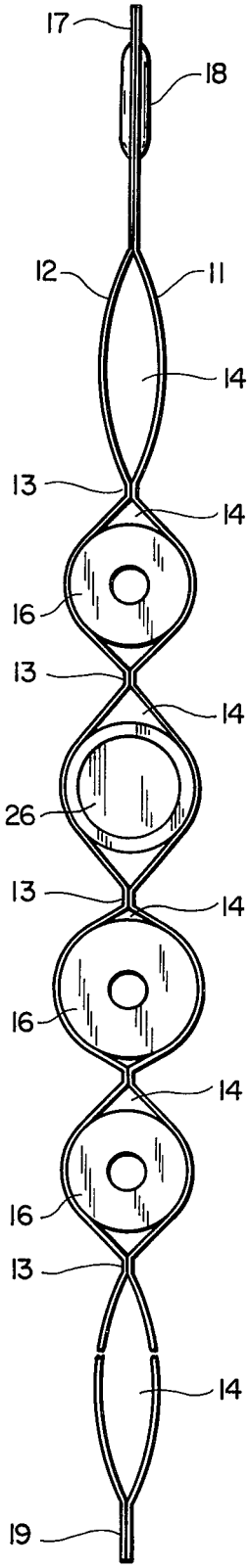
FIG. 2 is a side elevation of the spool holder of FIG. 1.

Referring to the Figures, the spool holder comprises first and second strips 11 and 12 to flexible material, preferably transparent elastic plastic material. It will be apparent to one skilled in the art that the flexible material may comprise cloth. Preferably, the material is a transparent plastic which can be heat sealed whereby it can be joined at spaced intervals to form a plurality of elongated pockets.

Referring more specifically to the drawings, the material is shown joined at the spaced regions 13 whereby to define transverse pockets 14 which can accommodate spools 16. The spools fit snugly in the pockets whereby they do not slip. The thread is protected from dust and prevented from unwinding. When the material is elastic it stretches to accommodate the spool and then holds the spool tightly in the holder. The pockets are are small as possible while providing ease of insertion and removal of the spools. Where the material is thermoplastic, the joints 13 may be formed by heating restricted areas and pressing the two strips together to form a bond. The bonding may also be an ultrasonic or radio frequency bond formed between bondable materials. The strips can be sewn to one another to provide the joint which defines the individual pockets 14.

The upper end of the spool holder is shaped as shown, for example, at 17 and provided with a grommet 18. The material may be bonded or joined on its edges to provide a joint between the two strips whereby to provide a sealed end. However, the grommet will hold the two strips together without the need for bond or joint. The grommet 18 provides means for hanging the spool holder on a nail, peg or other suitable holder. A plurality of spool holders may all be placed upon a split ring such as ring 21, FIG. 3, and hung in the closet where the complete assembly occupies a minimal space. The bottom of the spool holder is also joined as shown at 19. When spools are placed in the pockets and the holder suspended, the gravitational force will pull the pocket walls together to firmly hold the spools.

Figure 3:
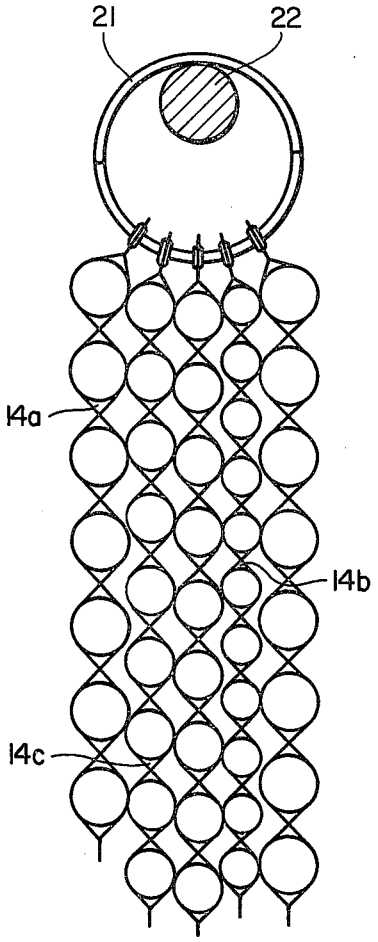
FIG. 3 shows a plurality of spool holders suspended from a closet pole by a ring.
Figure 4:
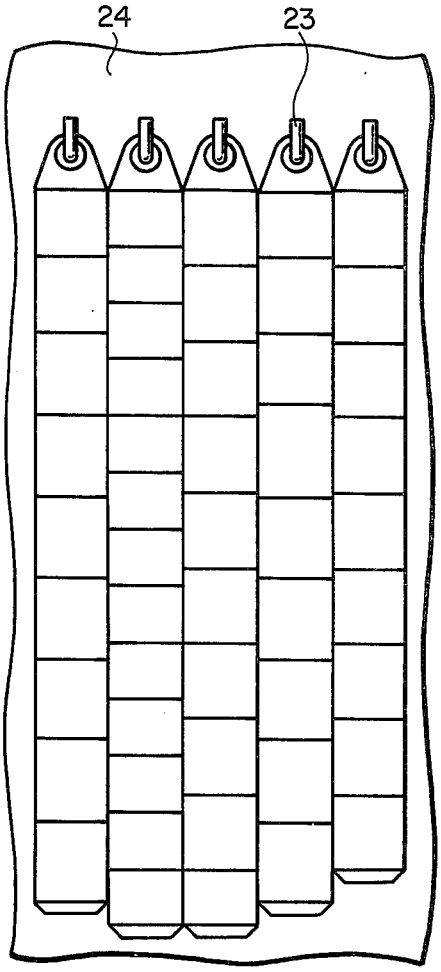
FIG. 4 shows a plurality of spool holders suspended from hooks.
Figure 5:
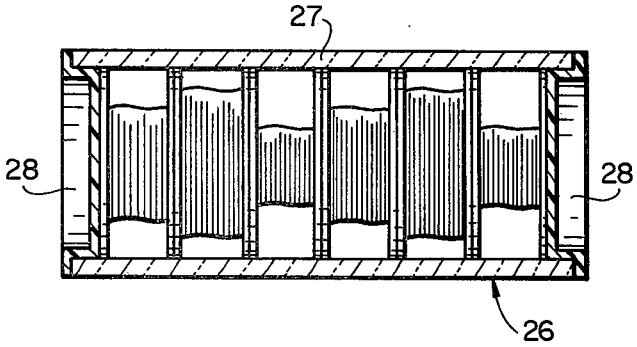
FIG. 5 is a sectional view showing a bobbin holder for use with the spool holder of the present invention.
Figure 6:
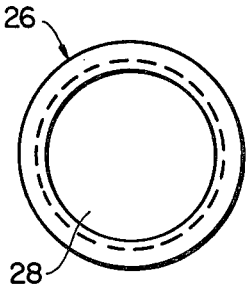
FIG. 6 is an end view of the bobbin holder of FIG. 5.

Referring to FIG. 3, a plurality of spool holders are shown mounted on a split ring 21. The ring may be placed over a closet pole 22 or hung from a door knob or other suitable holder. The spool holders have different size pockets **14*a*, 14*b* and 14*c* to accommodate and hold securely different size spools. The spool holders may also be mounted on individual pegs 23 which may be placed on the back of a door 24** or on a wall.

It may be desirable in certain instances to place bobbins in the pockets. For such purpose, a bobbin holder 26 may be provided. The bobbin holder may comprise a transparent cylindrical member 27, in which a plurality of bobbins 28 are disposed face to face. The ends of the cylinder are provided with end caps 28. The holder is then placed in a pocket in place of a spool 16.

Thus, there has been provided a simple, easy to use, attractive spool holder which occupies minimum space and protects the threads against tangling and shields the threads from the environment such as dust and soil from handling when searching for the proper color and size of thread.

What is claimed is:

1. A holder for spools comprising first and second elongated strips of material disposed face to face, means for connecting said strips to one another at spaced intervals therealong to define a plurality of parallel transverse elongated open-ended spool pockets each having uniform dimensions throughout its length disposed next to one another along said strips, the spacing of said means for connecting being selected to provide pockets which loosely removably accommodate the spools with the walls of said pockets being forced against the spools by gravitational force when the holder is suspended from one end to snugly removably hold the spools in the pockets.

2. A spool holder as in claim 1 including means at one end of said strips for hanging or suspending the spool holder.

3. A spool holder as in claim 1 wherein said strips are transparent strips thereby permitting viewing of the spools and thread disposed in the pockets.

4. A spool holder as in claim 1 wherein said strips are joined to one another at spaced intervals by ultrasonic bonding.

5. A spool holder as in claim 1 wherein said strips are joined to one another by thermal bonding.

6. A spool holder as in claim 1 wherein said strips are joined to one another by radio frequency bonding.

* * * * *